US005860812A

United States Patent [19]

Gugliotti

[11] Patent Number: 5,860,812

[45] Date of Patent: Jan. 19, 1999

[54] ONE PIECE MOLDED RF/MICROWAVE COAXIAL CONNECTOR

[75] Inventor: Carmine Gugliotti, Waterbury, Conn.

[73] Assignee: Litton Systems, Inc., Watertown, Conn.

[21] Appl. No.: 787,819

[22] Filed: Jan. 23, 1997

[51] Int. Cl.[6] ..... H01R 9/09

[52] U.S. Cl. ..... 439/63; 439/931

[58] Field of Search ..... 439/63, 581, 931

[56] References Cited

U.S. PATENT DOCUMENTS

| | | | |
|---|---|---|---|
| 3,980,382 | 9/1976 | Reeder . | |
| 4,645,288 | 2/1987 | Stursa . | |
| 4,718,854 | 1/1988 | Capp et al. | 439/63 |
| 4,718,864 | 1/1988 | Flanagan | 439/578 |
| 4,964,805 | 10/1990 | Gabany | 439/63 |
| 4,977,668 | 12/1990 | McKenzie, Jr. | 439/931 |
| 5,011,415 | 4/1991 | Suzuki et al. | 43/63 |
| 5,104,325 | 4/1992 | Mitani et al. | 439/63 |
| 5,120,258 | 6/1992 | Carlton | 439/63 |
| 5,145,382 | 9/1992 | Dickirson | 439/63 |
| 5,180,315 | 1/1993 | Nagashima | 439/581 |
| 5,344,341 | 9/1994 | Yoshino | 439/931 |
| 5,411,409 | 5/1995 | Gray et al. | 439/63 |
| 5,525,075 | 6/1996 | Michishita et al. | 439/63 |
| 5,647,768 | 7/1997 | Messuri et al. | 439/931 |

*Primary Examiner*—Neil Abrams
*Attorney, Agent, or Firm*—Michael H. Wallach

[57] ABSTRACT

A coaxial connector is disclosed having a selectively plated plastic body and a metallic centre contact which is press fit into an unplated portion of the dielectric body. The dielectric body achieves electrical isolation between the plated ground plane formed by the body and the centre conductor.

8 Claims, 3 Drawing Sheets

ONE PIECE MOLDED RF/MICROWAVE COAXIAL CONNECTOR

FIELD OF THE INVENTION

This invention relates in general to electrical connectors and more particularly to a one-piece plastic molded connector with press-fit conductive centre contact and plating selectively applied for providing a conductive ground.

BACKGROUND OF THE INVENTION

Coaxial board or case mounted receptacles are well known in the art for connecting coaxial cables and printed circuit boards (PCBs) in RF and microwave applications.

The most common connector presently in use for RF and microwave applications comprises a metallic body housing a Teflon™ insulator with metallic centre contact. Other connectors incorporate various combinations of metal and plastic components to provide a signal-carrying centre contact and an outer ground-connecting contact plane. Examples of such prior art are found in U.S. Pat. Nos. 4,645,288; 5,120,258; 4,964,805; 4,718,864; 4,934,960; 5,411,409; 5,180,315; 5,104,325; 5,011,415 and 3,980,382.

In an effort to provide an RF coaxial connector with proper impedance and which is surface-mountable directly to a PCB in an automatic assembly process, U.S. Pat. No. 5,145,382 discloses a molded plastic surface-mountable coaxial connector which includes a molded platable dielectric body. The '382 patent requires both a plated centre contact portion and a plated ground contact portion separated by a layer of resist. The centre contact portion comprises a selectively plated aperture which is an integral part of the dielectric body. As such, the centre contact does not replicate the ubiquitous metal connector designs known in the art and therefore is not intermateable and interchangeable therewith. Instead, the connector disclosed in U.S. Pat. No. 5,145,382 requires a unique plug-in mating piece. Because the centre conductor is plated, multiple insertions of a coaxial cable into the connector can result in wearing off of the conductive plating.

SUMMARY OF THE INVENTION

According to the present invention, a RF or microwave coaxial connector is provided having a selectively plated plastic body and a compliant screw machined or stamped and formed metallic centre contact which is press fit into an unplated portion of the dielectric body. As with the prior art '382 patent, the connector according to the present invention is of one-piece molded construction with selectively plated portions. However, in contrast with the '382 patent, the centre contact is press-fit into an unplated portion of the connector body so as to readily mate with existing cable connectors which are in prevalent use throughout the RF and microwave industry. The connector according to the present invention achieves electrical isolation between the plated ground plane and centre conductor with standard impedance, without requiring an extra resist application as provided by the system disclosed in the '382 patent.

BRIEF DESCRIPTION OF THE DRAWINGS

A detailed description of the preferred embodiment is provided herein below with reference to the following drawings, in which.

DETAILED DESCRIPTION OF THE PREFERRED EMBODIMENT

Figure 1:
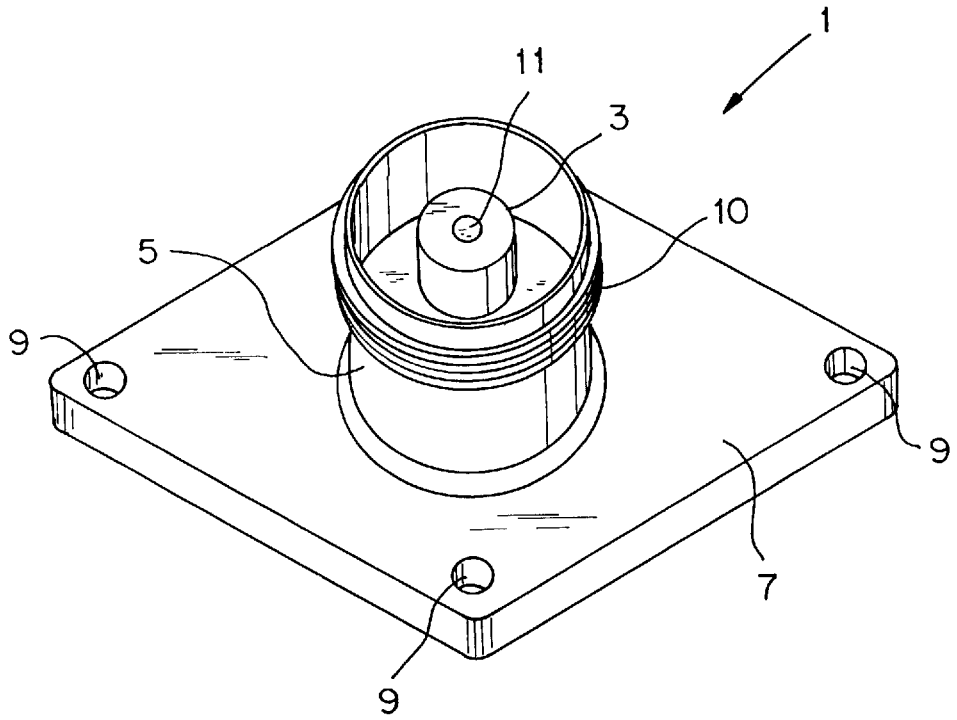
FIG. 1 is a perspective view of a connector in accordance with the present invention.
Figure 2B:
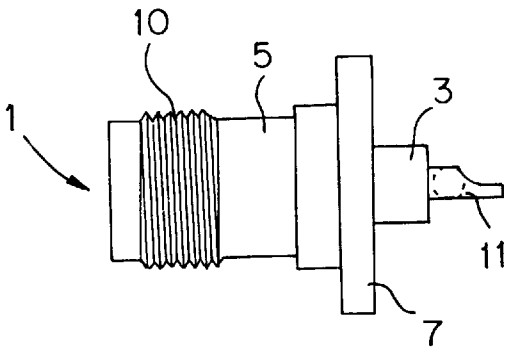
FIGS. 2A and 2B are plan and elevation views, respectively, of the connector shown in FIG. 1.
Figure 2A:
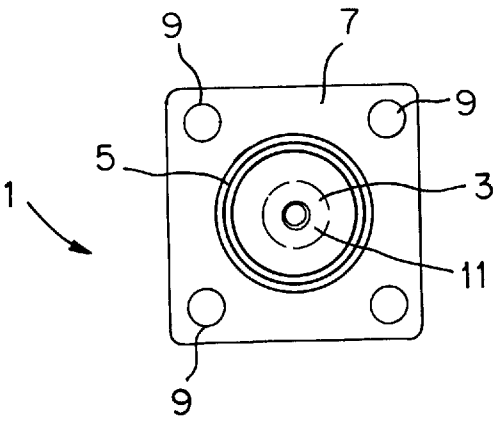

With reference to FIGS. 1–3, the connector according to the present invention is shown comprising a one-piece molded body 1 of dielectric material such as acetal resin. The body comprises an inner cylindrical portion 3 surrounded by an outer annular portion 5. A base portion 7 extends from a distal end of cylindrical annular portion 5 and is provided with a plurality of holes 9 for screw mounting the connector to a printed circuit board (PCB not shown). Alternatively, the base 7 can be mounted to a PCB or case by means of surface mount solder, through-hole solder, conductive epoxy or press-fit feet (see alternative embodiment of FIG. 3).

According to an important aspect of the present invention, the body 1 is selectively plated so that inner and outer surfaces of the outer cylindrical annulus 5 and the entire outer surface of the base 7 are plated with an electrically-conductive material such as electroless copper/nickel. Electroless plating is a method of immersion plating (coating) via a chemical reaction, without the use of an external source of electric current. In other words, electroless plating is characterized by selective reduction of metal ions only at the surface of a catalytic substance, immersed into an aqueous solution, and continued deposition on that substrate through the catalytic action of the deposit itself.

The outer annular portion 5 can be provided with a plurality of threads 10 or other types of RF mating for connection to a threaded coaxial ground contact sleeve of the coaxial cable (not shown). Alternatively, the portion 5 can include two or more outward-facing plated studs (not shown) to effect mechanical and electrical contact between the body 1 and mating connector. The inner cylindrical portion 3 of the body is left un-plated and a metallic centre contact 11 is press-fit therein. The centre contact 11 is preferably formed from copper alloy with a gold over nickel finish. Selective plating of the body 1 provides a conductive ground which is electrically isolated from the centre conductor.

The centre contact 11 can be screw machined or stamped and formed in a well know manner, and can be attached to an appropriate PCB trace via surface mount solder, a press-fit connection, through-hole solder or conductive epoxy.

Appropriate selection of a dielectric platable material, for example acetal dielectric resin manufactured by E. I. DuPont de Nemours and Company and plating material can be used to achieve a desired impedance (e.g. 50 ohms nominal impedance), and to provide appropriate dielectric withstanding voltage (e.g. typically 1500 VRMS), insulating resistance (e.g. greater than 5000 Megaohms) and provide acceptable durability for mating and unmating cycles.

Figure 3C:
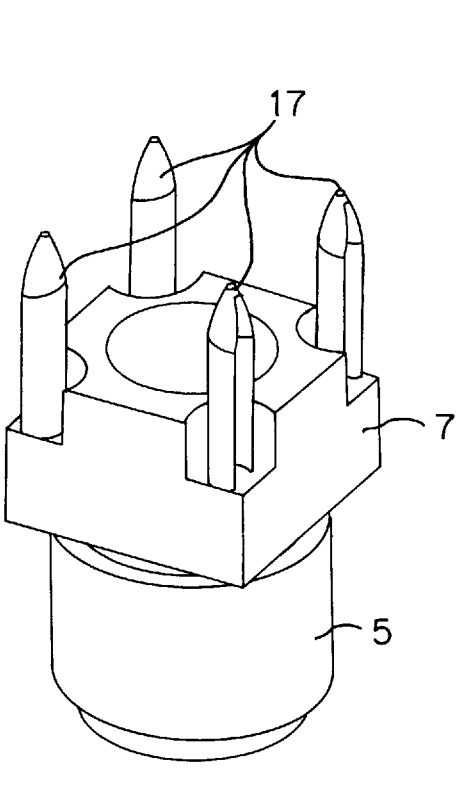
FIGS. 3A, 3B and 3C are perspective views of a connector with integrally molded feet, according to an alternative embodiments of the invention.
Figure 3B:
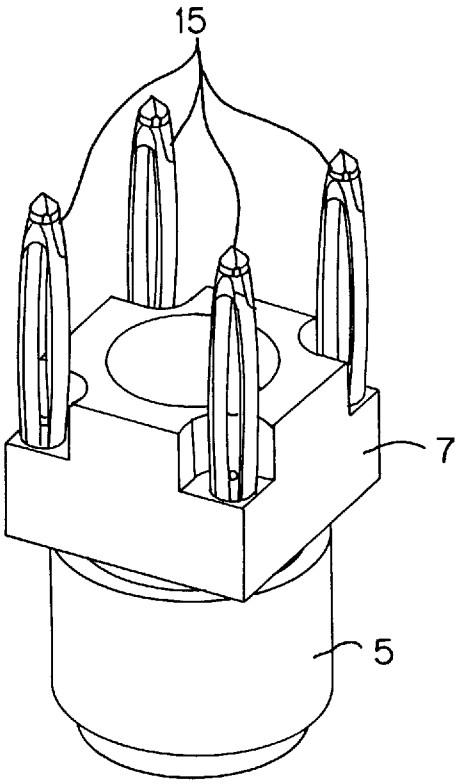
Figure 3A:
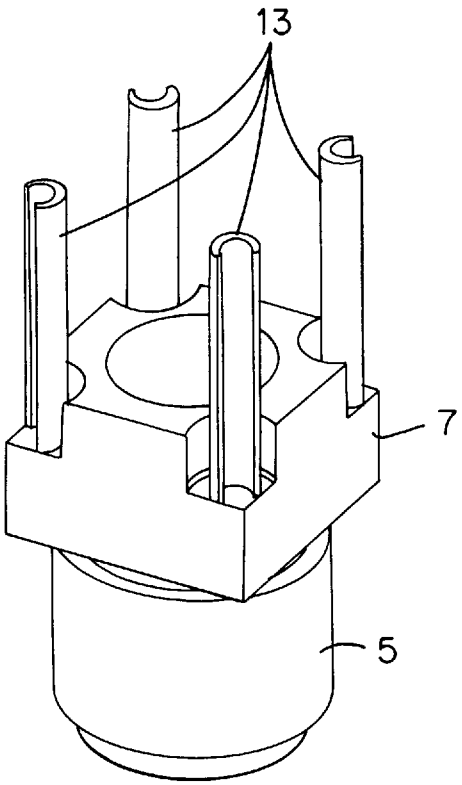

Alternative embodiments and modifications of the invention are possible. For example, as shown in FIGS. 3A, 3B and 3C, the connector body 1 can be attached to a surface (eg: a PCB or other device), by a variety of different means including compliant, press-fit legs 13, 15 or 17, respectively, which fit into corresponding holes in the surface (not shown). Also, although the embodiments shown in FIGS. 1–3 relate to a single connector, it is contemplated that multiple connectors may be molded into a common base, with selective plating and individual press-fit centre metallic conductors, to produce a variety of RF devices such as RF splitters or combiners. All such embodiments and modifications are believed to be within the sphere and scope of the present invention as defined by the claims appended hereto.

I claim:

1. An electrical connector attachable to a mounting surface, comprising:

a one-piece molded body of dielectric material having an inner portion surrounded by an outer portion and a mounting portion attachable to the mounting surface;

a metallic center contact press-fit into said inner portion; and conductive plating on said outer portion;

wherein said metallic center contact is electrically isolated from said conductive plating on said outer portion and from said conductive plating on said mounting portion by said inner portion, wherein said inner portion is cylindrical, and said outer portion includes an annular cylindrical portion surrounding said cylindrical inner portion, and said mounting portion includes a base portion protecting from an end of said annular cylindrical portion for attaching said connector to said mounting surface.

2. The electrical connector of claim 1, wherein said base portion defines a plurality of holes extending there through for screw mounting of said connector.

3. The electrical connector of claim 1, wherein said base portion includes a plurality of feet for press-fit mounting of said connector to a mounting surface.

4. The electrical connector of claim 1, wherein said dielectric material is acetal resin and said conductive plating is one of either electroless copper/nickel, aluminum, silver or gold.

5. The electrical connector of claim 1, wherein said metallic centre contact is fabricated from copper alloy with a gold over nickel finish.

6. The electrical connector of claim 1, wherein said annular cylindrical portion is threaded.

7. The electrical connector of claim 1, wherein the electrical connector is one of an RF and microwave connector.

8. The electrical connector of claim 1, wherein said inner portion and said outer portion are cylindrical.

* * * * *